US006800327B2

(12) United States Patent
Bechem et al.

(10) Patent No.: US 6,800,327 B2
(45) Date of Patent: Oct. 5, 2004

(54) METHOD AND APPARATUS FOR COATING METAL STRIP, PARTICULARLY COLD-ROLLED STEEL STRIP

(75) Inventors: Werner Bechem, Hilchenbach (DE); Holger Behrens, Erkrath (DE); Rolf Brisberger, Issum (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 10/147,282

(22) Filed: May 16, 2002

(65) Prior Publication Data

US 2002/0170493 A1 Nov. 21, 2002

(30) Foreign Application Priority Data

May 16, 2001 (DE) ..... 101 23 784

(51) Int. Cl.[7] ..... B05D 3/12; B05C 13/00

(52) U.S. Cl. ..... 427/349; 427/436; 427/433; 118/63; 118/67; 118/68

(58) Field of Search ..... 427/348, 349, 427/434.2, 435, 436, 318, 319, 321, 320, 328, 329, 431, 432, 433; 118/63, 61, 58, 423, 64–69; 34/454, 578, 68, 405, 414; 15/309.1, 306.1

(56) References Cited

U.S. PATENT DOCUMENTS 4,330,574 A * 5/1982 Pierson et al.

FOREIGN PATENT DOCUMENTS

GB 2048959 12/1980

OTHER PUBLICATIONS

Patent Abstracts of Japan, vol. 018, No. 344 (C–1218), Jun. 29, 1994 & JP 06 081093 A (Kawasaki Steel Corp), Mar. 22, 1994.

Patent Abstracts of Japan, Col. 005, No. 140 (C–070), Sep. 4, 1981 & JP 56 072165 A (Chugai Ro Kogyo Kaisha Ltd), Jun. 16, 1981.

* cited by examiner

*Primary Examiner*—Brenda A. Lamb
(74) *Attorney, Agent, or Firm*—Friedrich Kueffner

(57) ABSTRACT

A method and an apparatus for coating metal strip, particularly cold-rolled steel strip, with a coating metal which is in the molten state. The metal strip is heated and annealed in a heating furnace and subsequently the required strip temperature and surface properties are adjusted in a cooling zone. The strip is conducted through a coating container and, following the coating container in strip pulling direction, the coating metal thickness and the solidification process are controlled by a gas-operated stripping device. The operating gas for the stripping device is preheated in a partial area of the cooling zone of the heating furnace.

8 Claims, 1 Drawing Sheet

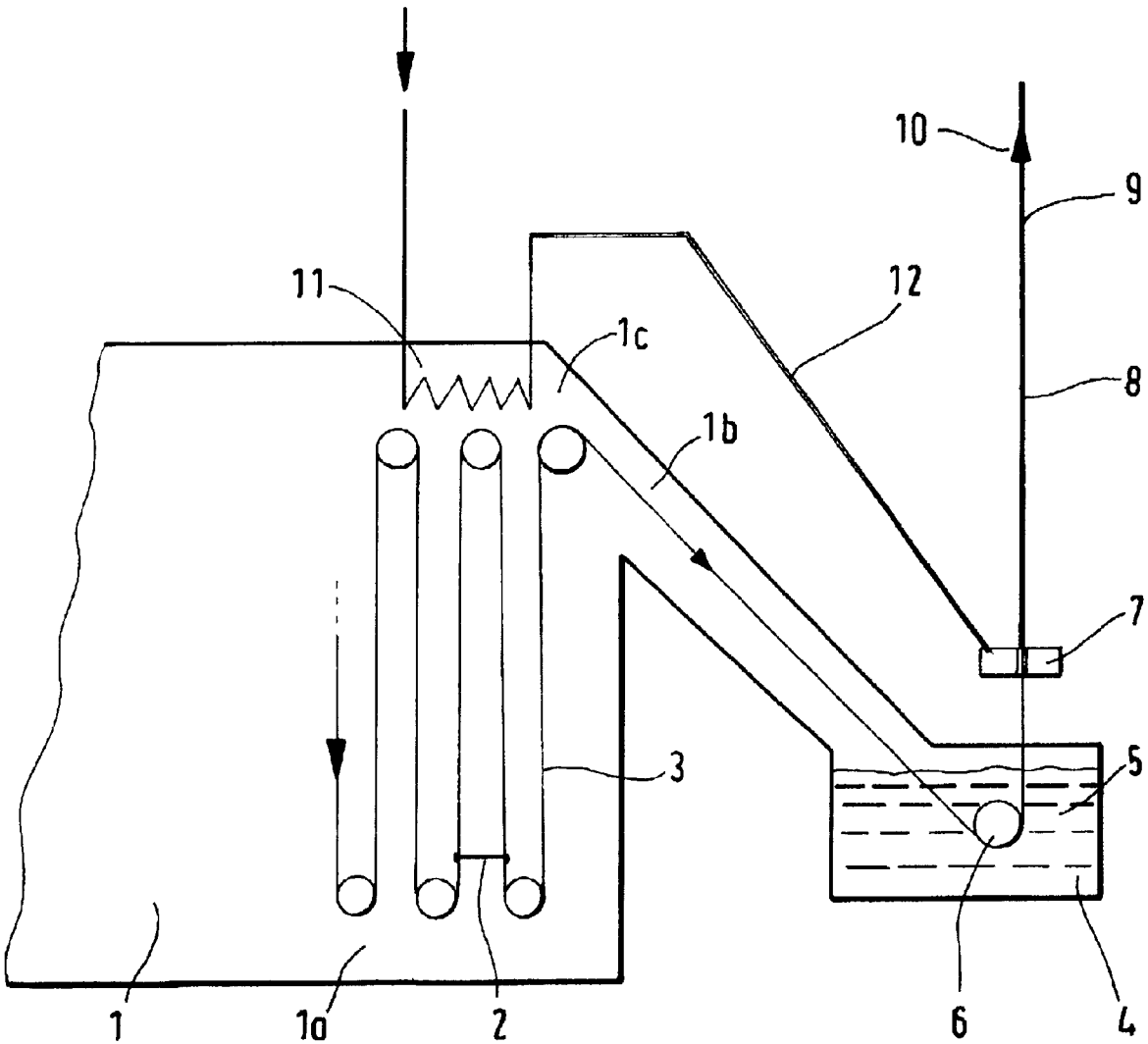
9
8
7
5
4
10
12
6
1b
1c
3
2
11
1a
1

METHOD AND APPARATUS FOR COATING METAL STRIP, PARTICULARLY COLD-ROLLED STEEL STRIP

BACKGROUND OF THE INVENTION

1. Field of the Invention

The present invention relates to a method and an apparatus for coating metal strip, particularly cold-rolled steel strip, with a coating metal which is in the molten state. The metal strip is heated and annealed in a heating furnace and subsequently the required strip temperature and surface properties are adjusted in a cooling zone. In additional steps, the strip is guided through the coating container and, behind the coating container in strip pulling direction, the thickness of the coating metal and the solidification process are controlled by means of a gas-operated stripping device 2. Description of the Related Art After the strip has been pulled out of the coating container, the coating metal, for example, zinc, which is still liquid on the strip surface is stripped by means of the gas-operated stripping device and is conveyed back downwardly into the coating metal container. This makes it possible to adjust a defined and uniform thickness of the metal layer, for example, zinc layer, on the strip surface. It is known in the art to supply the gas of the stripping device in the cold state to the nozzle. This manner of operation is carried out primarily with nitrogen.

SUMMARY OF THE INVENTION

It is the primary object of the present invention to improve the stripping behavior of the liquid coating metal on the strip surface in order to save coating metal and to still achieve a good surface quality.

In accordance with the present invention, the operating gas for the stripping device is preheated in a partial area of the cooling zone of the heating furnace.

As a result of the present invention, the gas can now be supplied to the stripping device in the heated state for stripping the liquid coating metal. This produces an improved stripping behavior on the strip surface. This, in turn, makes possible thinner thicknesses of the coating metal and an improved surface quality. Moreover, the use of the preheated operating gas makes it possible to reduce the operating costs because the volume expansion at increased temperatures as compared to the delivery state results in a lower consumption in relation to the delivered quantity.

In accordance with a further development, preheating is carried out in a temperature range of between 20° C. to 250° C.

In accordance with another feature, air, nitrogen or a non-oxidizing gas are used for preheating the operating gas.

The present invention also proposes an apparatus for coating metal strip, particularly cold-rolled steel strip, with liquid coating metal, for example, zinc. The apparatus includes a heating furnace in which the metal strip can be adjusted by annealing and in a cooling zone to the temperature required for coating the strip. The apparatus further includes a coating container and a gas-operated stripping device arranged following the coating container in the strip pulling direction. The object of the present invention is met by arranging a heat exchanger within the cooling zone of the heating furnace for the metal strip, wherein the gas for the stripping device can be preheated in the heat exchanger The heated operating gas can now produce the effect of the improved stripping behavior and the thinner coating metal layers without additional operating costs by means of a quantity of heat which has been removed from the heating furnace.

The apparatus according to the present invention is further simplified by using the heat exchanger instead of one of the cooling zones in the heating furnace.

In accordance with another advantageous feature, the heat exchanger is arranged instead of the cooling zone provided at the exit of the heating furnace.

In accordance with another development, a conveying means for the preheated gas of the stripping device extends directly from the heat exchanger to the stripping device.

The conveying means for the preheated gas of the stripping device can be arranged alongside the duct extending from the heating furnace to the coating container. As a result, the apparatus of the invention does not require a significant amount of additional space.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a longitudinal sectional view of a rearward furnace area with the strip coating apparatus.

DETAILED DESCRIPTION OF THE INVENTION

The apparatus for coating metal strip 3 is arranged following a heating furnace 1 which includes a cooling zone 1*a*. The metal strip 3 travels through this cooling zone 1*a* in a strip storage means 2 and is guided at the end of the strip storage means through a duct 1*b* to a coating container 4 and is conveyed through the coating metal 5, for example, liquid zinc, around a guide roller 6 and is coated. The adjustment of the coating layer thickness takes place outside of the coating container 4 at a stripping device 7 in which the preheated operating gas, preferably air or nitrogen, is blown against the coated metal strip 3 and excess coating metal 5 is pushed back into the coating container 4. The metal strip 9 coated with a layer having a thickness 8 is then conveyed away in a strip pulling direction 10.

The coating thickness 8 can now be applied very thinly and uniformly and with a surface having a good quality because the operating gas, i.e., air or nitrogen, is first conducted into a heat exchanger 11 where the gas is heated by the heat of the heating furnace 1 and the gas is conducted directly from the heat exchanger 11 through a supply line 12 to the stripping device 7, wherein the supply line extends essentially parallel to the duct 1*b*. The operating gas is heated to a temperature of 20° C. to 250° C.

While specific embodiments of the invention have been shown and described in detail to illustrate the inventive principles, it will be understood that the invention may be embodied otherwise without departing from such principles.

We claim:

1. A method of coating metal strip, particularly cold-rolled steel strip, with a coating of metal which is in the molten state, the method comprising heating and annealing the metal strip in a heating furnace, subsequently adjusting a required strip temperature and surface properties in a cooling zone, and, in additional steps, guiding the strip through the coating container and, following the coating container in a strip pulling direction, controlling a coating metal thickness and solidification process with a stripping device which is operated with an operating gas, further comprising preheating the operating gas for the stripping device with a heat exchanger arranged in a partial area of the cooling zone of the heating furnace and conveying the preheated gas of the stripping device directly from the heat exchanger to the stripping device.

2. The method according to claim 1, comprising carrying out preheating in a temperature range of 20° C. to 250° C.

3. The method according to claim 1, comprising using air, nitrogen or a non-oxidizing gas for preheating the operating gas.

4. The method according to claim 1, wherein the coating metal is zinc.

5. An apparatus for coating metal strip, particularly cold-rolled steel strip, with liquid coating metal, the apparatus comprising a heating furnace for adjusting the metal strip by annealing and in a cooling zone to a coating strip temperature, and a gas-operated stripping device arranged following the coating container in a strip pulling direction, further comprising a heat exchanger arranged within a cooling zone of the heating furnace for preheating gas for the stripping device, and further comprising a conveying means for the preheated gas of the stripping device extending directly from the heat exchanger to the stripping device.

6. The apparatus according to claim 5, wherein the heating furnace has several cooling zones, and wherein the heat exchanger is arranged replacing one of the cooling zones.

7. The apparatus according to claim 6, wherein the heat exchanger is arranged in the heating furnace replacing a cooling zone arranged at an exit of the heating furnace.

8. The apparatus according to claim 5, wherein the conveying means for the preheated gas of the stripping device extends essentially parallel to a duct for the metal strip extending from the heating furnace to the coating container.

* * * * *